US005212978A

United States Patent [19]

Liu

[11] Patent Number: 5,212,978

[45] Date of Patent: May 25, 1993

[54] TERMINAL POSITIONING STRUCTURE OF CLAMPING TOOL

[76] Inventor: Lien-Huang Liu, No. 17, Alley 166, Lane 68, Sua-Yuan Rd., Feng-Yuan City, Taichung Hsien, Taiwan

[21] Appl. No.: 834,943

[22] Filed: Feb. 14, 1992

[51] Int. Cl.[5] ..... H01R 43/042

[52] U.S. Cl. ..... 72/410; 72/461; 29/751

[58] Field of Search ..... 72/410, 409, 461, 416; 29/751; 81/421-423

[56] References Cited

U.S. PATENT DOCUMENTS

| | | | |
|---|---|---|---|
| 2,359,083 | 9/1944 | Carlson | 72/410 |
| 3,673,848 | 7/1972 | Filia | 72/410 |
| 3,931,671 | 1/1976 | Dittmann | 29/753 |
| 4,637,242 | 1/1987 | Undin | 72/410 |
| 4,982,594 | 1/1991 | Wiebe | 72/410 |

FOREIGN PATENT DOCUMENTS

| | | | |
|---|---|---|---|
| 2382957 | 11/1978 | France | 72/461 |

*Primary Examiner*—Daniel C. Crane

*Attorney, Agent, or Firm*—Browdy and Neimark

[57] ABSTRACT

A terminal positioning structure of crimping tool comprises a base having thereon a first restriction portion and a second restriction portion forming jointly a terminal holding area. The first restriction portion is provided with a pair of clamping members capable of adjusting the width of the terminal holding area, while the second restriction portion is composed of arresting memers capable of adjusting the height and the depth of the terminal holding area in accordance with the dimension of the terminal intended to be worked on. Teh terminal to be worked on is securely gripped with precision in the terminal holding area of the crimping tool.

6 Claims, 3 Drawing Sheets

TERMINAL POSITIONING STRUCTURE OF CLAMPING TOOL

BACKGROUND OF THE INVENTION

The present invention relates to a clamping tool (also known as a crimping tool in the tool industry), and more particularly to a terminal positioning structure of clamping tool.

As shown in FIG. 1, a crimping tool 10 of prior art is provided with clamping teeth 12 serving to receive one end of a terminal 14 holding therein a wire 16 with its insulation sheath 15 stripped. The other end of the terminal 14 is arranged insuch a manner that it extends beyond the side of the crimping tool 10. It is often difficult to stabilize the terminal 14 on the clamping teeth 12 which have relatively small holding area. As a result, an operator is required to hold firmly not only the crimping tool 10 but also the terminal 14 and the wire 16 so as to prevent the terminal 14 from moving aside or the wire 16 from tripping. Therefore, it is often difficult for an operator to do a good job with such crimping tool which has an inherent structural defect. In addition, an operator using such crimping tool is subjected to injury, while the quality of the job done is greatly compromised.

SUMMARY OF THE INVENTION

It is therefore the primary object of the present invention to provide a crimpiong tool with means capable of stabilizing with precision the terminal intended to be coupled.

It is another objective of the present invention to provide a crimping tool with positioning structure capable of holding with precision any terminal without regard to its size.

In keeping with the principles of the present invention, the foregoing objectives of the present invention are accomplished by a crimping tool, which comprises mainly a base disposed by the side of a tool mouth. The base comprises a terminal holding area corresponding to a clamping portion of the tool mouth so as to permit one end of the terminal held in the tool mouth to extend to the terminal holding area. The crimping tool of the present invention further comprises a first restriction portion and a second restriction portion, which are intended for use in adjusting the width, height and depth of the terminal holding area.

The foregoing and reatures of the present invention will be better understood by studying the following detailed description of two preferred embodiments in conjunction with drawings provided herewith.

DETAILED DESCRIPTION OF THE PREFERRED EMBODIMENTS

Figure 1:
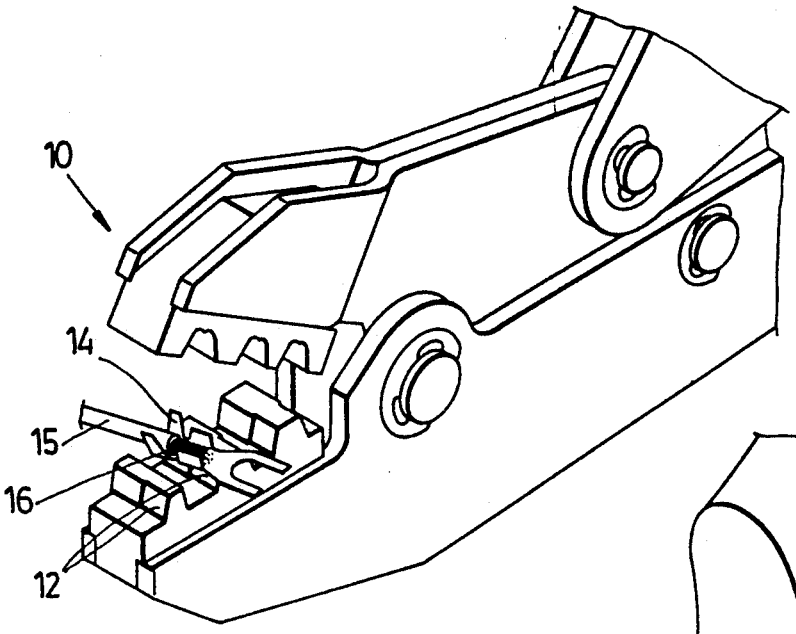
FIG. 1 PRIOR ART
FIG. 1 shows a three-dimensional schematic view of a crimping tool of prior art at work.
Figure 2:
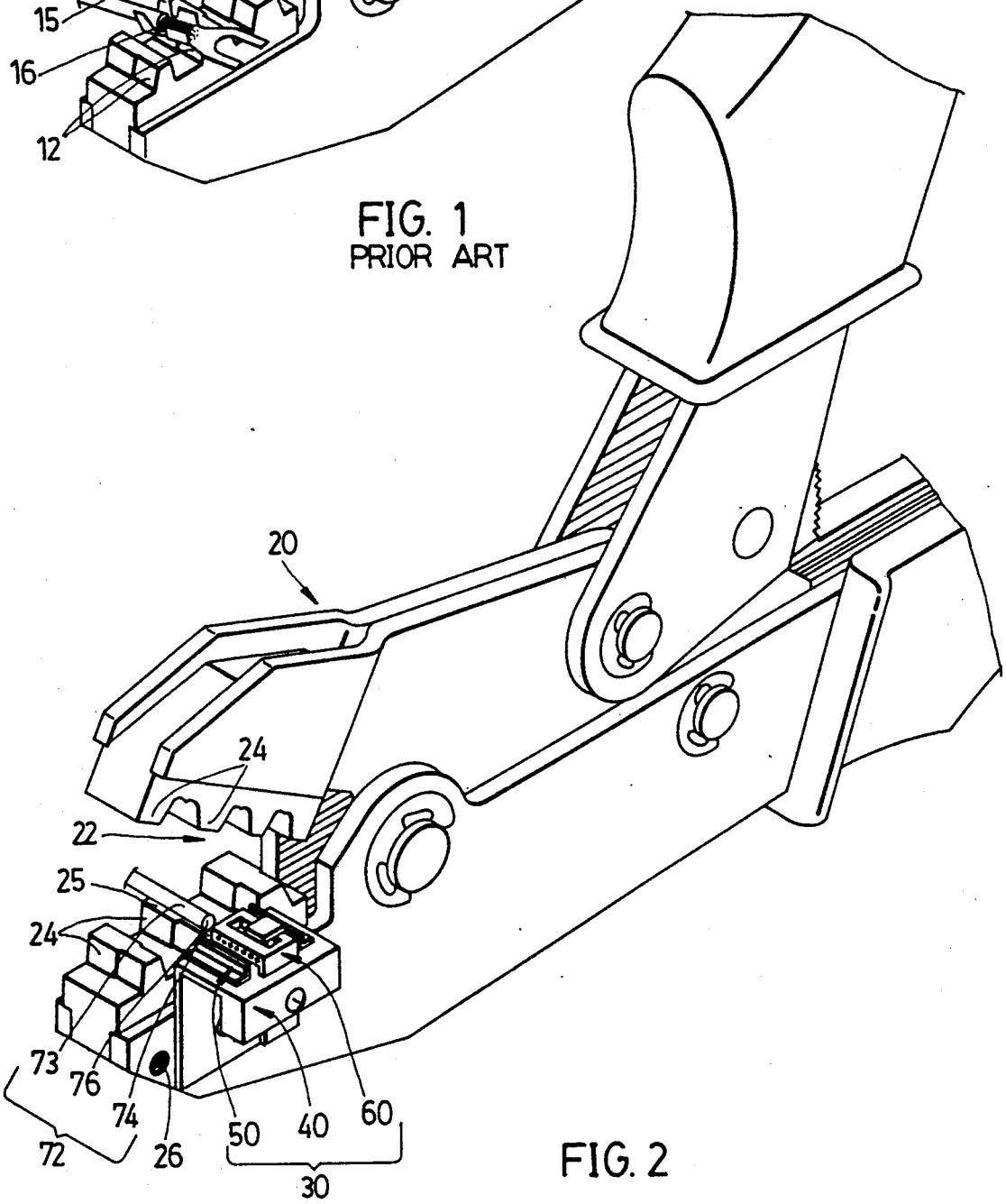
FIG. 2 shows a three-dimensional schematic view of a crimping tool embodied in the present invention.
Figure 3:
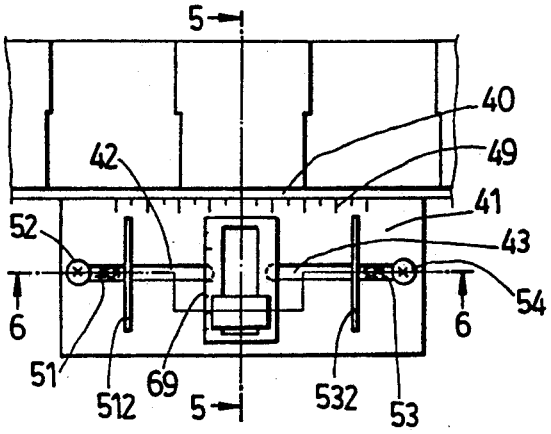
FIG. 3 shows a top view of a crimping tool of the present invention.
Figure 4:
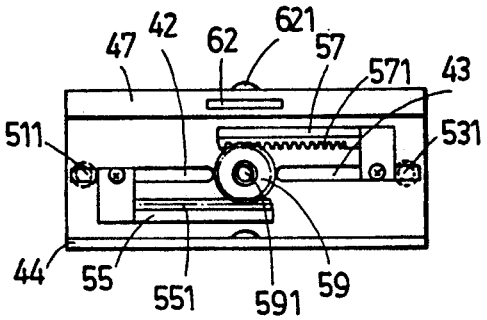
FIG. 4 shows a bottom view of a crimping tool of the present invention.
Figure 5:
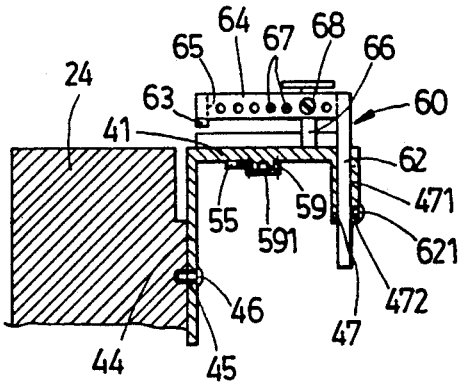
FIG. 5 shows a sectional view of aportion taken along line 5—5 as shown in FIG. 3.
Figure 6:
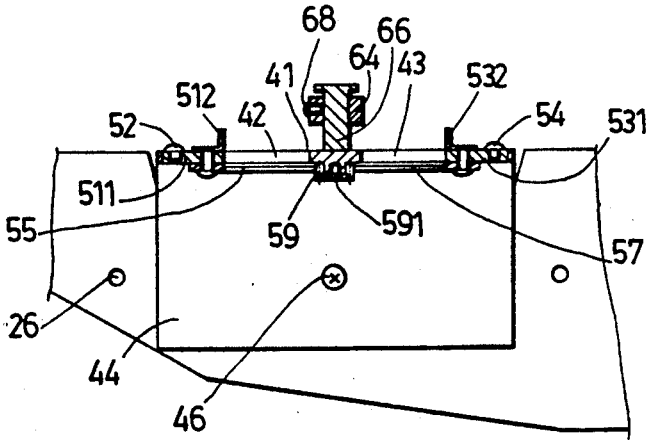
FIG. 6 shows a sectional view of a portion taken along line 6—6 as shown in FIG. 3.

As shown in FIGS. 2–8, a terminal positioning structure 30 of the present invention is secured to teh side of a tool mouth 22 of crmiping tool 20 in such a manner that it is disposed correspondingly to a tool tooth 24 located in the tool mouth 22. The terminal positioning structure 30 comprises a base 40, a first restriction portion 50, and a second restriction portion 60.

The tool mouth 22 of the crimping tool 20 has three pairs of tool teeth 24 arranged oppositely one another. The tool mouth 22 is provided at its side with three first threaded hoels 26, each of which is positioned correspondingly to a gripping surface 25 of the tool teeth 24.

The base 40 has a receiving portion 41, a suspended flap 44 and a flange 47 which are disposed in such a manner that they extend downwardly and respectively from the front and the rear ends of the receiving portion 41, which is further provided along the long axis thereof with a left and a right elongate holes 42 and 43 spaced apart by a predetermined distance. The suspended flap 44 is provided with a circular hole 45 communicating the front and rear sides thereof. The flange 47 is composed of a first slot 471 in communication with the upper end of the receiving portion 41 and the lower end of the flange 47, and of a second threaded hole 472 communicating the rear end thereof. The suspended flap 44 is fastened to teh side of tool mouth 22 by means of a screw 46 in conjunction with circular hole 45 corresponding to one of the first threaded holes 26.

The first restriction portion 50 comprises a left clamping member 51, a right clamping member 53, a left serrated rod 55, a right serrated rod 57, and a gear 59 pivotally arranged between the left and the right serrated rods 55 and 57. The left and the right clamping members 51 and 53 disposed respectively on the receiving portin 41 are provided respectively wit upwardly extended side baffles 512 and 532, and with downwardly extended sliding blocks 511 and 531 which are inserted respectively into the left and the right elongate holes 42 and 43 in such a manner that they can slide laong the long axis of the base 40. The sliding blocks 511 and 531 are provided respectively with positioning screws 52 and 54 with tail ends thereof extending beyond the upper end of the base 40 and with outer diameters thereof being greater than the widths of the left and the right elongate holes 42 and 43. As a ersult, after having been moved to a predetermined position, the clamping members 51 and 53 can be stationed securely at that predetermine dpositin by means of the positioning screws 52 and 54. The left and the right serrated rods 55 ad 57 are fastened respectively to the lower end of corresponding sliding blocks 512 and 532 in such a manner that their engageable gears 551 and 571 are positioned oppositely udner the receiving portin 41. The gear 59 is disposed pivotally under the receiving portion 41 by means of a pivot 591 and is located between the left and the right serrated rods 55 and 57 in such a manner that it meshes with the engageable gears 551 and 571 of the serrated rods 55 and 57. Therefore, the left and the right clamping members 51 and 53 can be actuated respectively by the left and the right serrated rods 55 and 57 so as to remain close or apart.

The second restriction portion 60 of an inverted L construction is inserted at its lower end 62 into teh first slot 471 located at the rear end of the base 40, in such a manner that it can slide upwardly and downwardly. As a result, the height of the second restrictin portion 60 can be adjusted at will and put into a fixed positon by means of a screw 621 in conjunction with the second threaded hole 472. Located at one end of an upper portion 64 of the second restriction portion 60 are a suppression block 63 extending downwardly and a second slot 65 perpendicular to teh long axis of teh base 40 and communicating the upper and the lower portions of the second restriction portion 60. An arresting block 66 is slidably disposed in the second slot 65. The second restrictin portion 64 is further provided on the side of upper portion 64 thereof with a plurality of the third threaded holes 67 in communication with the second slot 65. The arresting block 66 is locked by means of a screw 68 which engages one of the third threaded holes 67 in such a manner that its front end urges against the side of the portion of the arresting block 66 disposed in the second slot 65.

The terminal holding area 76 provided with an opening facing the tool mouth 22 is formed jointly by side baffles 512 and 532 of the first restriction portion 50, suppression block 63 and arresting block 66 of the second restriction portion 60, and upper surface of the base 40.

The upper surface of the base 40 is provided between the clamping members 51 and 53 with a first graduated area 49 for facilitating the operator to identify the distance between the clamping members 51 and 53 moving oppositely. The upper portin 64 of the second restriction area 60 is provided with a second graduated area 69 along the long axis of the second slot 65 for the purpose of hoelping the operator identify the distance between the front end of the arresting block 66 and the side of the tool mouth 22.

On the basis of teh size of a terminal 72, the operator can adjust the width, the height and the depth of the terminal holding area 76 adjusting the distance between the side baffles 512 and 532, the distance between the lower end of suppression block 63 and the upper end of the base 40, and the distance between the front end of arresting block 66 and the side of the tool mouth 22. The terminal 72 is placed in the gripping surface 25 of the tool tooth 24, with the front end 74 thereof inserted into the terminal holding area 76 so as to stabilize securely the terminal 72 in place with precision.

Figure 8:
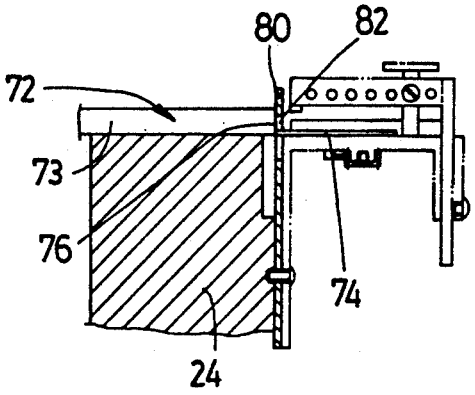
FIG. 8 shows a sectional view of a portion taken along line 8—8 as shown in FIG. 7.
Figure 7:
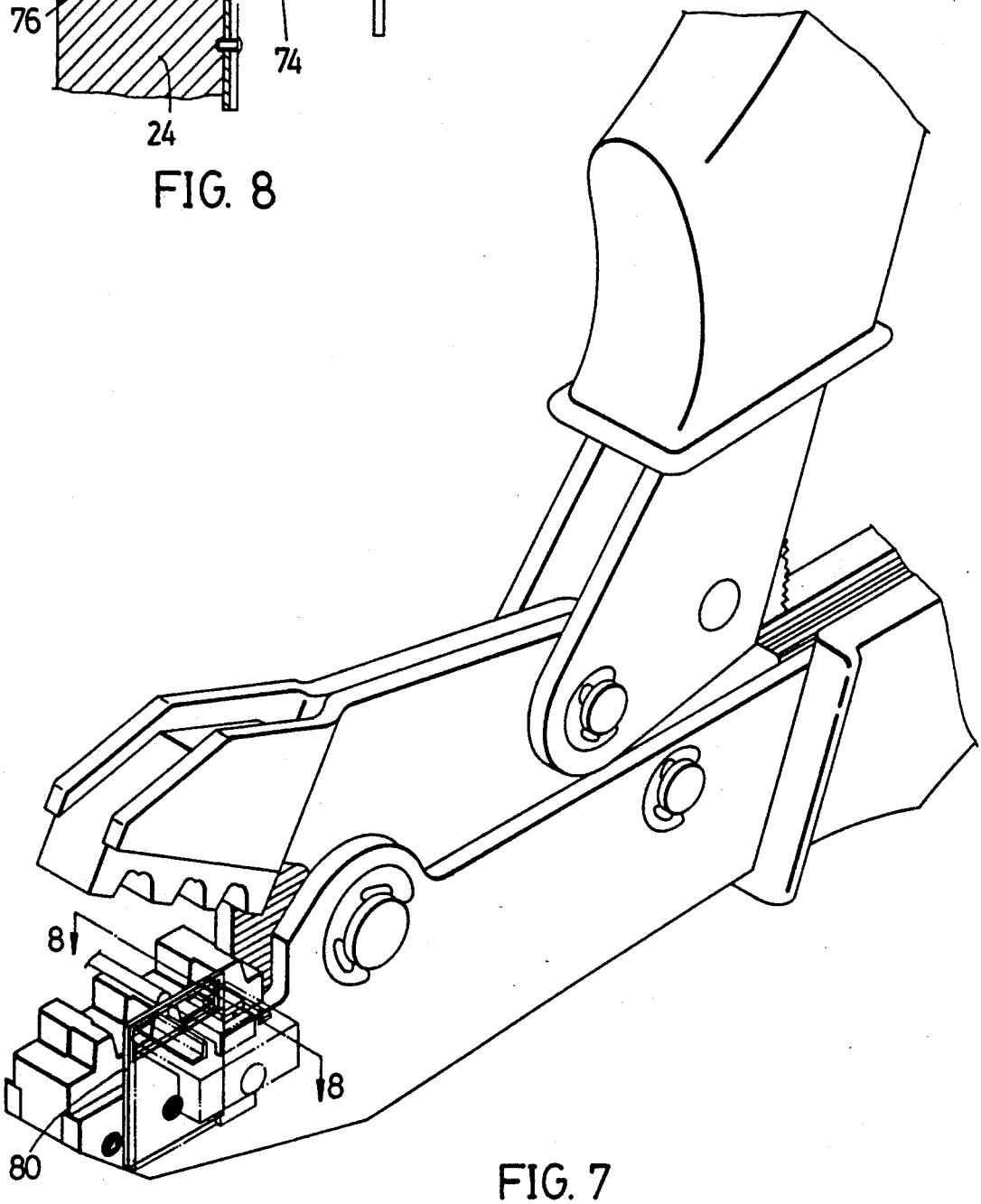
FIG. 7 shows a three-dimensional schematic view of another crimping tool embodied in the present invention.

Now referring to FIGS. 7 and 8, the crimping tool of the present invention is shown further comprising an arresting ring 80 disposed fixedly between the tool mouth 22 and the terminal positioning structure 30. The arresting ring 80 of flat plate construciton is provided with a through hole 82. In operating the crimping tool of the present invention, the front end 74 of the terminal 72 is arranged in the terminal holding area 76 via the through ole 82 in such a manner that a shoulder portio 78, which is formed between the press connection porti 73 located in the gripping surface 25 and the front end 74 of the terminal 72, urges against the arresting ring 80 facing the side of the tool tooth 24 so as to result in a retaining effect.

The terminal holding area 76 formed by the base 40, the first restriction portion 50 and the second restriction portion 60 is characterized in that its width, depth and height can be simply adjusted to fit the dimension of a terminal intended to be worked on. Such structural design as disclosed in the present invention is innovative and inventive.

What is claimed is:

1. A terminal positioning structure for use with a crimping tool having a pair of jaws with corresponding dies thereon for crimping electrical conductors to a terminal while axes of said terminal and conductor extend in a predetermined direction, at least one of said jaws having a side extending transverse to said axes, said terminal positioning structure comprising:

a base having an attachment surface extending transverse to said axes for attachment to a side of one of said pair of jaws;

a pair of collinear slots on said base extending parallel to said side and transverse to said axes;

each of a pair of clamping members selectively positioned in slidable engagement in said pair of slots;

said each one of said pair of clamping members having a baffle above said base, each baffle having surfaces for engagement with said terminal;

wherein said base and said baffle of said each of said pair of clamping members form a selectively sized first restriction portion of a terminal holding area by movement of said baffles towards and away from one another in a direction transverse to said axes for gripping one end of said terminal therein so that the axes of the terminal extends parallel to said baffle surfaces during the crimping of an electrical conductor by said crimping tool to said terminal.

2. A terminal positioning structure according to claim 1, wherein said clamping members are provided respectively with a first positioning means for sliding and locking said each of said pair of clamping members to a selected position on said pair of slots.

3. A terminal positioning structure according to claim 2, wherein said first positioning means comprises:

a serreated rod located below said base and connected to each of said pair of clamping members;

a rotatable gear pivotally mounted on a lower surface of said base;

each said serrated rod engaged to said rotatable gear to slide said each of said pair clamping members in said pair of slots; and positioning screws on each of said pair of clamping means for engagement to said pair of slots when in a locked position.

4. A terminal positioning structure according to claim 2, further comprising a third slot parallel to said pair of slots on said base;

a pedestal portion slidable in said third slot in a direction vertical to said base;

second positioning means for locking said pedestal portion in a selected position;

an extension portion integrally engaged perpendicular to said pedestal portion;

said extension portion extending perpendicular toward said side on one of said pair of jaws;

an elongated hole disposed insaid extension portion;

an arresting block slidably engaged in said elongated hole and extending down toward said base;

third positioning means for locking said arresting block in a selected position;

wherein, said base, said extension and said arresting block form a selectively sized second restriction portion of said terminal holding area for gripping said one end of said terminal therein.

5. A terminal positioning structure according to claim 4, wherein said third positioning means comprises a plurality of threaded holes and screws engaged to said threaded holes so that said screws extend into said elongate hole to urge against said arresting block.

6. A terminal positioning structure according to claim 5, further comprising an arresting ring locked between said base and said side on one of said jaws, said arresting ring provided with a through hole located correspondingly to said terminal holding area to permit a connector to be crimped to said terminal to be retained behind said arresting ring and between said pair of jaws.

* * * * *